US007056092B2

(12) United States Patent
Stahl

(10) Patent No.: US 7,056,092 B2
(45) Date of Patent: Jun. 6, 2006

(54) MODULAR PROPELLER

(76) Inventor: Bradford C. Stahl, 1006 Cougar Creek, Arroyo Grande, CA (US) 93420

( * ) Notice: Subject to any disclaimer, the term of this patent is extended or adjusted under 35 U.S.C. 154(b) by 35 days.

(21) Appl. No.: 10/821,830

(22) Filed: Apr. 9, 2004

(65) Prior Publication Data

US 2005/0226724 A1 Oct. 13, 2005

(51) Int. Cl.
*B63H 1/20* (2006.01)

(52) U.S. Cl. ..... 416/93 A; 416/129; 416/214 R; 416/219 A; 416/220 A; 416/241 A; 416/244 B; 440/67; 440/81; 440/89 A

(58) Field of Classification Search ..... 416/93 A, 416/219 A, 220 A, 244 B, 245 A, 214 R, 416/241 A, 128–129; 440/67, 80–81, 89 R, 440/89 A
See application file for complete search history.

(56) References Cited

U.S. PATENT DOCUMENTS 3,817,202 A * 6/1974 Holtermann ..... 440/89 A
3,876,331 A * 4/1975 DenHerder et al. ..... 416/93 A
4,180,368 A * 12/1979 Henrich et al. ..... 416/93 A
4,875,829 A * 10/1989 Van der Woude ..... 416/93 A
4,930,987 A 6/1990 Stahl
5,423,701 A 6/1995 Rodskier
5,556,313 A * 9/1996 Ogino ..... 440/80
5,575,698 A * 11/1996 Ogino ..... 416/129
5,800,223 A * 9/1998 Iriono et al. ..... 440/81
5,989,664 A * 11/1999 Takayama et al. ..... 416/214 R

FOREIGN PATENT DOCUMENTS

SU 1093619 A * 5/1984 ..... 416/93 A

* cited by examiner

*Primary Examiner*—Christopher Verdier
(74) *Attorney, Agent, or Firm*—Robert Charles Hill

(57) ABSTRACT

A modular propeller comprises a center hub with an integrated front cap and an aluminum core encapsulated with fiber-reinforced composite polymer resin. A set of replaceable blades have bases that slip into and interlock with corresponding slots in the center hub. An elongated rear cap retains the blades in the center hub. The rear cap includes a nozzle section for expelling exhaust gasses that pass through the center parts of the hub and blade bases.

6 Claims, 4 Drawing Sheets

MODULAR PROPELLER

BACKGROUND OF THE INVENTION

1. Field of the Invention

The present invention relates to propellers, and more particularly to modular propellers used on boats that allow the individual blades to be replaced.

2. Description of Related Art

A plastic marine propeller and hub assembly is described by the present inventor, Brad Stahl, in U.S. Pat. No. 4,930,987, issued Jun. 5, 1990, herein "Stahl '987". Three plug-in blade roots are slipped into an interlocking hub between front and rear end caps. All the parts are made of injection-molded high-strength fiber-reinforced plastic. The manufacturing costs of such propellers are said to be half the cost of conventional metal propellers. Typical applications are 16–18 inch diameter three blade propellers intended for 90–250 horsepower motors.

A double propeller is described in U.S. Pat. No. 5,423,701, issued Jun. 13, 1995, to Christian Rodskier, et al. The inner sleeves of the respective propeller hubs includes axial passages for venting the exhaust gases of the engine it is attached to. This arrangement is said to be novel for double propellers and increases the overall propeller efficiency.

Prior art commercial products similar to Stahl '987 taper the blade bases and corresponding center hub slots by 3–5 degrees. They are wider at the rear, and so the blades are replaced from the aft of the assembly. Such tapers were intended to help secure the blades in the hubs, but in practice the blades are loose in the hub slots. Replacing a broken blade in the field becomes much more difficult if it is jammed too tightly in the hub. The high taper angles also cause the blade to become loose while flexing under load in the completed assembly.

SUMMARY OF THE INVENTION

Briefly, a modular propeller embodiment of the present invention comprises a center hub with an integrated front cap and an aluminum core encapsulated with fiber-reinforced composite polymer resin. A set of replaceable blades have bases that slip into and interlock with corresponding slots in the center hub. An elongated rear cap retains the blades in the center hub. The rear cap includes a nozzle section for expelling exhaust gasses that pass through the center parts of the hub, blade bases, and rear cap.

An advantage of the present invention is that a propeller is provided that is modular.

Another advantage of the present invention is that a modular propeller assembly is provided that is inexpensive to manufacture.

A further advantage of the present invention is that a modular propeller assembly is provided that is stronger than prior art units.

Another advantage of the present invention is that a modular propeller assembly is provided that has exhaust chambers that are divided by vanes which improve engine performance.

A still further advantage of the present invention is that a modular propeller assembly is provided with counter rotating assemblies, and has twice the benefit.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
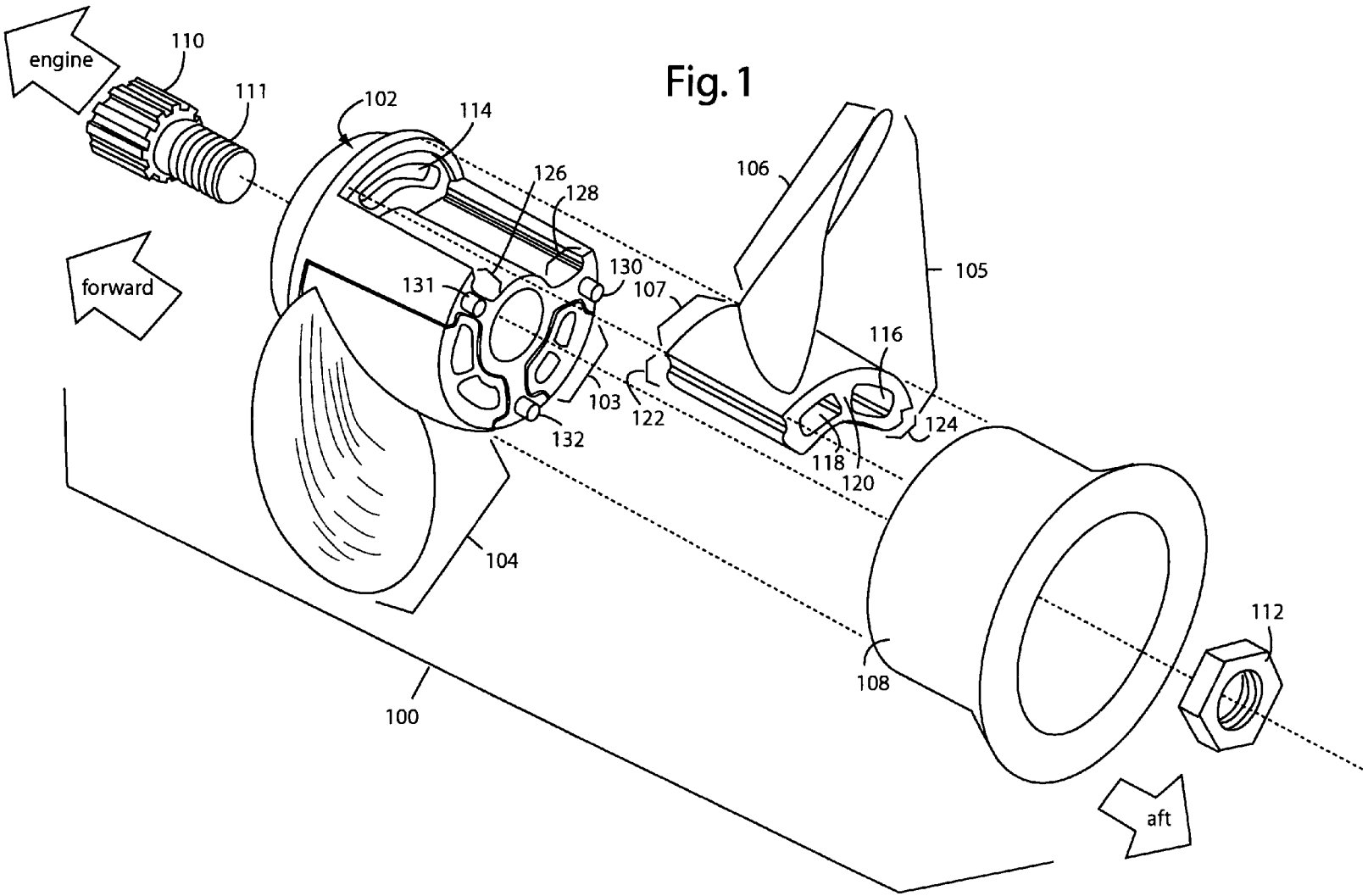
FIG. 1 is a perspective view of a modular propeller embodiment of the present invention in an exploded assembly with three blades in which two are visible.

FIG. 1 illustrates a modular propeller embodiment of the present invention, referred to herein by the reference numeral 100. The propeller 100, in this example, is useful on inboard/outboard and outboard boat motors and comprises a center hub 102, an interlocking replaceable propeller blade units 103–105. Each replaceable propeller blade unit, e.g., 105, includes a blade 106 and a root 107. A rear cap 108 secures the replaceable propeller blade units 103–105 to the center hub 102. The assembled modular propeller 100 typically mounts on a splined shaft 110 of an outboard marine engine. A threaded portion 111 is used to fasten the whole assembly with a machine nut 112. The replaceable propeller blade units 103–105 are all identical, and commercial implementations allow users to choose a variety of sizes and blade pitches. As few as two and as many as six evenly distributed blades can be used in various embodiments of the present invention. Typical applications are 8–18 inch diameter three blade propellers intended for 6–350 horsepower motors.

Figure 2:
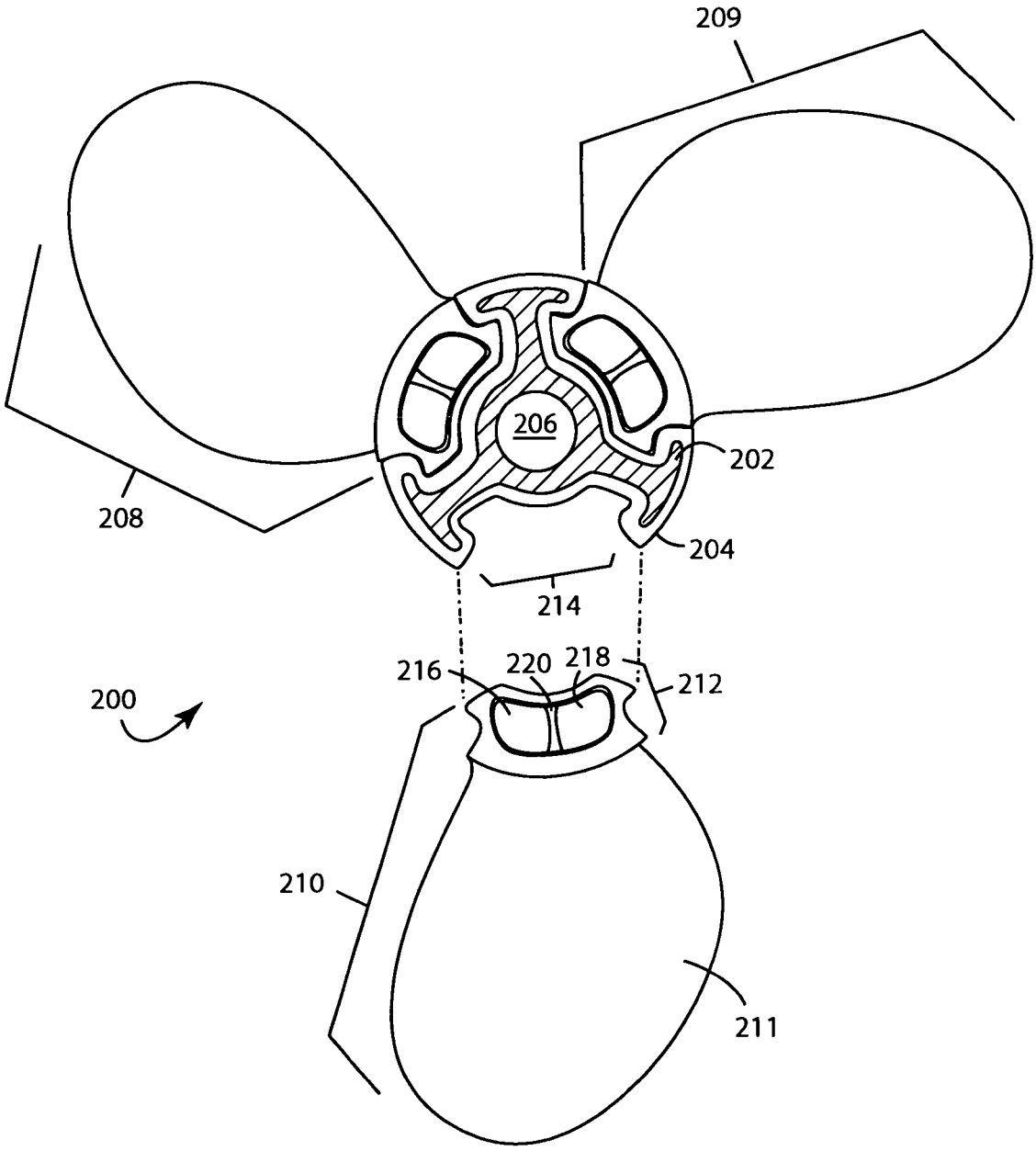
FIG. 2 is a cross-sectional view of another modular propeller embodiment of the present invention similar to that of FIG. 1.

The center hub 102 has an aluminum core encapsulated in long-fiber reinforced composite polymer resin, such as, VERTON marketed by LNP Engineering Plastics, Inc. (Exton, Pa.), or other engineering thermal plastics. FIG. 2 is an example which illustrates such construction. The flexural stiffness of any panel is proportional to the cube of its thickness. A composite laminate core acts to increase the laminate's stiffness by effectively thickening it with a low-density core material. Such provides a substantial increase in stiffness for very little additional weight. In commercial practice, the encapsulated aluminum core allows shorter splined sections to be used and so a wider variety of motors can be accommodated by fewer models. Such also allows higher powered motors to be used for similar weight and size propellers.

The aluminum core of center hub 102 is machined internally with splines that match those of splined shaft 110. In contrast, the prior art used splines that were pressed in with a rubber bushing. The intent was to provide some "give" if the propeller struck something solid. In practice, the rubber bushing has proven to be ineffective in preventing engine damage. In embodiments of the present invention, the blades themselves are intended to absorb energy in order to prevent drive train damage.

The typical inboard/outboard and outboard boat motor exhausts its spent combustion gases out through the propeller. (The exhaust ports in the front of rear hub 108 are not visible in the perspective of FIG. 1.) The pumping action of the propeller helps to draw the gases out of the engine and to cool them by mixing with water. A hub port 114 is typical of three ports, in which exhaust gases are passed back through matching blade ports 116 and 118 out through rear cap 108. Such helps improve engine performance.

A webbing-vane 120 between blade ports 116 and 118 increases the overall strength and stiffness of replaceable blades 103–105. Such webbing-vane 120 further helps evacuate the exhaust gases better because larger chambers can be used without compromising the assembly strength. In one embodiment, such webbing-vane 120 is not full length, and stops well short of the forward interface with hub 102 and port 114.

The propeller blade units 103–105 have, for example on propeller blade unit 105, shoulders 122 and 124 which are axially tapered to fit similarly axially tapered slots 126 and 128 in the hub 104. Such tapers are set at 0.01–3.0 degrees, and widen aft of the assembly. The 0.01–3.0 degree taper used here is less than the taper angles used in the prior art, and provides for tighter fits without jamming or loosening.

The rear cap 108 mates with index pins 130–132 to hold its alignment with the center hub 102. This is especially important to align the exhaust ports with one another so there is a clear, unobstructed passage throughout the whole assembly.

FIG. 2 illustrates a three bladed modular propeller embodiment of the present invention, and such is referred to herein by the general reference numeral 200. The modular propeller 200 comprises an aluminum metal hub core 202 that is encapsulated in an injection molded hub 204. A coaxial bore 206 is internally splined to fit on the driveshafts of a variety of boat motors. A set of replaceable, sacrificial blade units 208–210 have, e.g., a blade 211, and a base root 212 that slips into an interlocking cavity 214. Each base root 212 has exhaust chambers 216 and 218 that are divided by at least one vane 220.

Figure 3A:
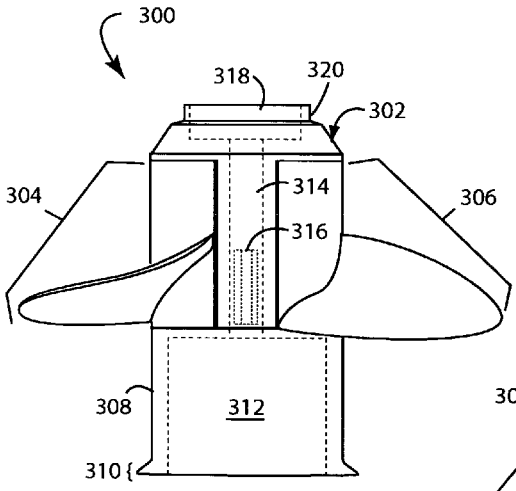
FIG. 3A is a side view of a modular propeller embodiment of the present invention, shown here with the front part that faces an outboard motor at the top of the drawing, and wherein the third blade is not visible in this view and the next.
Figure 3B:
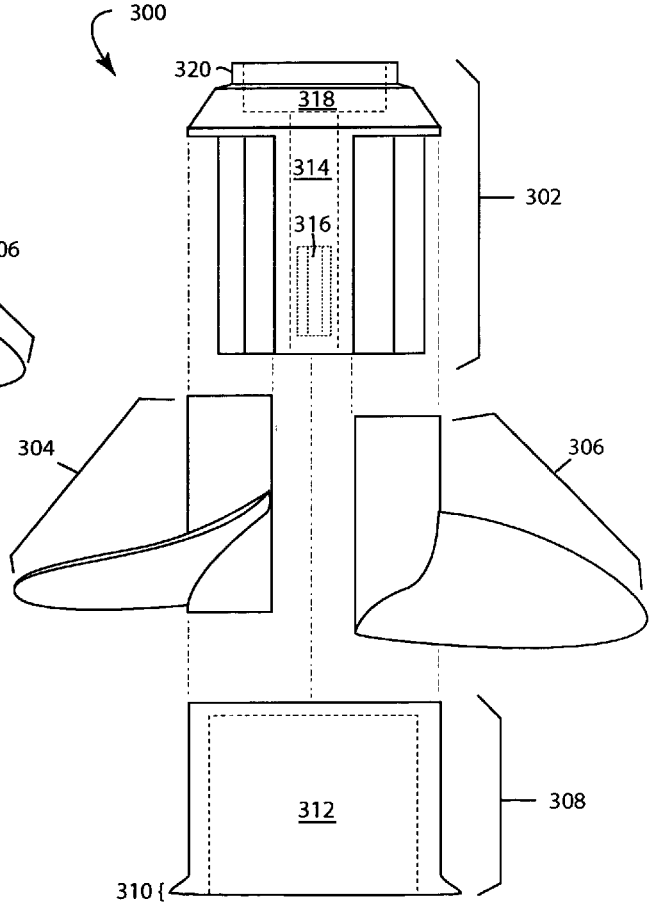
FIG. 3B is an exploded assembly side view of the three blade modular propeller of FIG. 3A, wherein the third blade is not visible in this view.

FIGS. 3A and 3B illustrate another three bladed modular propeller embodiment of the present invention, and such is referred to herein by the general reference numeral 300. The modular propeller 300 comprises an integrated front cap and hub 302. A set of three identical, replaceable, sacrificial blades, as represented by blades 304 and 306, slip into corresponding, identical, axially tapered slots on hub 302. A rear cap 308 retains the blades and includes a flare 310. A nozzle well 312 conducts exhaust gases out and away from the turning propeller blades. Ports in the front of nozzle well 312 pass such exhaust gases received from hollow chambers inside each blade base. A coaxial bore 314 includes foreshortened internal splines 316 to fit on the driveshafts of a variety of outboard and inboard/outboard motors. It is important to note here the splines 316 do not run the full axial length of bore 314. A front well 318 collects the exhaust gases as they are received from the motor. A ring 320 helps seal in the exhaust gases so they don't leak into and mix with the water being pushed by the blades.

Figure 4A:
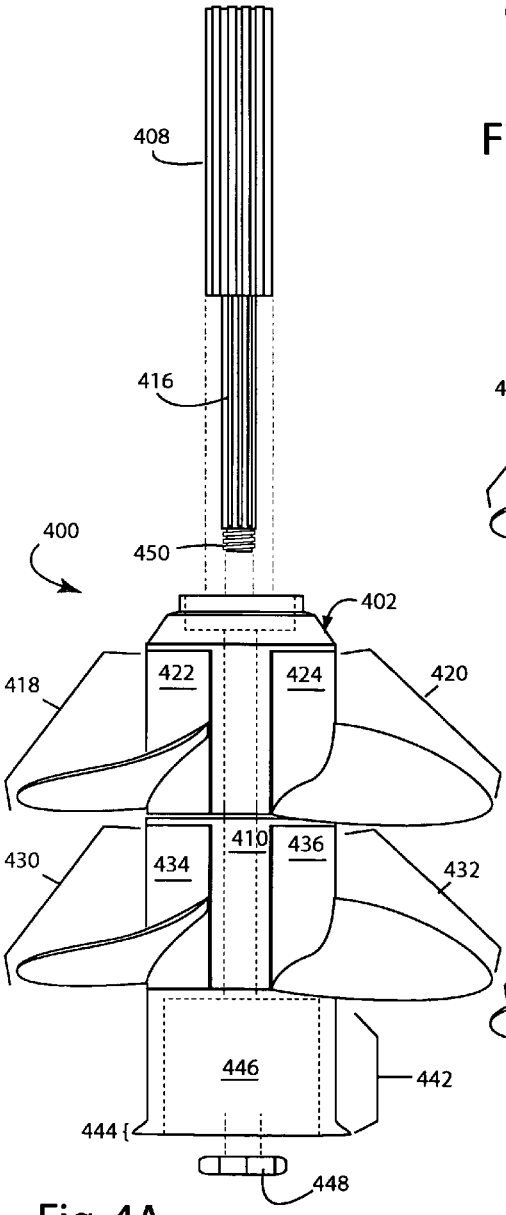
FIG. 4A is a side view of a modular counter rotating propeller embodiment of the present invention, shown here with the front part that faces an outboard motor at the top of the drawing, and wherein a third blade is not visible.
Figure 4B:
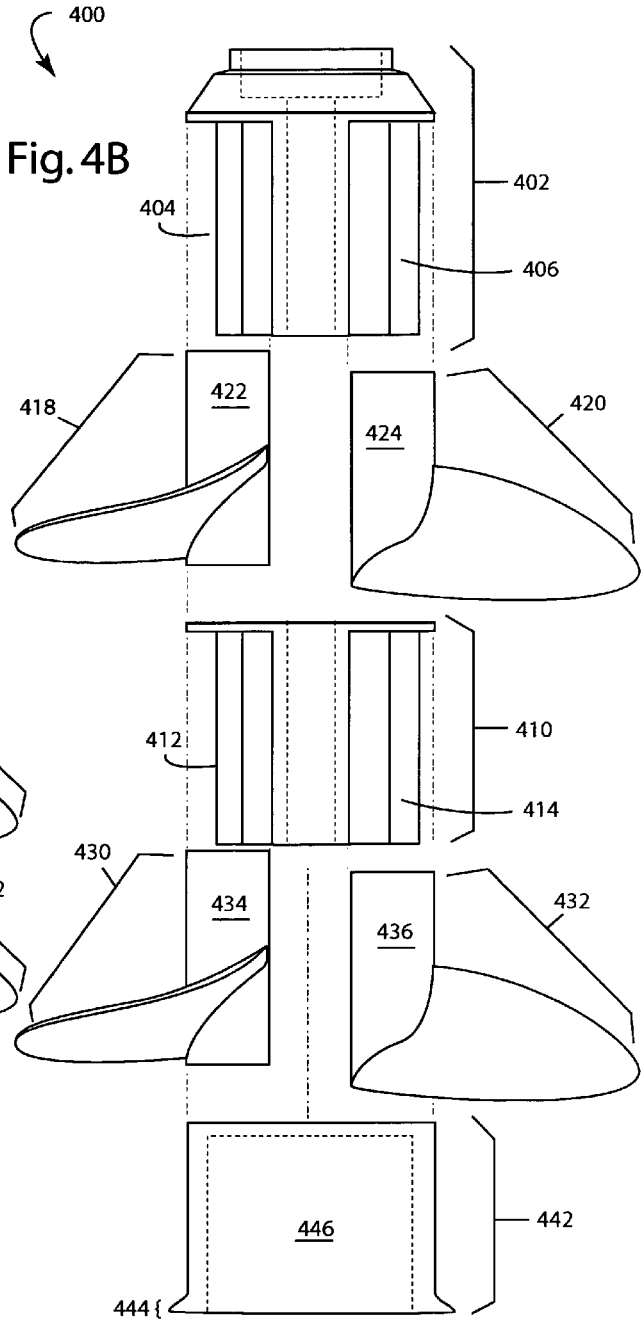
FIG. 4B is an exploded assembly side view of the modular counter rotating propeller of FIG. 4A, wherein the third blade is not visible.

FIGS. 4A and 4B illustrate a modular counter rotating propeller embodiment of the present invention, and such is referred to herein by the general reference numeral 400. The modular counter rotating propeller 400 comprises a front center hub 402 with a first set of propeller-blade receptacle slots 404–406 and mounts on a rotating engine driveshaft 408. A rear center hub 410 with a second set of propeller-blade receptacles 412–414 mounts on a counter-rotating engine driveshaft 416 coaxial to the rotating engine driveshaft 408 and aft of the front center hub 402. A first set of replaceable propeller blades 418–420 have plug-in bases 422–424 that slip into and interlock with corresponding slots 404–406 in the front center hub. A second set of replaceable propeller blades 430–432 with plug-in bases 434–436 slip into and interlock with corresponding slots 412–414 in the rear center hub 410.

As represented in FIG. 2 by chambers 216 and 218, a first set of chambers is disposed in the bases 422–424 for receiving exhaust gases from an engine associated with the rotating and counter-rotating engine driveshafts 408 and 416. Such provide for conducting exhaust gases aft (down in FIGS. 4A and 4B). Another second set of similar chambers is disposed in the replaceable propeller blade bases 434–436 for receiving exhaust gases from the front set of bases 422–424, and for conducting such exhaust gases out aft through a nozzle 442. A flare 444 helps gas and water flow out of a rear cavity 446. A nut 448 retains the assembly on a machine-threaded portion 450 of driveshaft 416.

During use, the exhaust gases do not mix with any free stream water contacting and being driven by the first or second set of replaceable propeller blades until exiting the propeller assembly aft of the flare 444. So a laminar flow of water free of exhaust gas bubbles passes over the blades and makes the propeller more efficient in driving the boat.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A modular propeller, comprising:

a center hub with an integrated front cap and an aluminum core encapsulated with fiber-reinforced composite polymer resin in a single piece;

a set of replaceable blades with bases that slip into and interlock with corresponding slots in the center hub; and a rear cap for retaining the set of blades in the center hub.

2. The propeller of claim 1, further comprising:

a coaxial bore extending front-to-rear through the center hub for mounting the propeller to a shaft; and a set of splines disposed in the coaxial bore and having a foreshortened axial length that provides for mounting on a larger number of motor types.

3. The propeller of claim 1, further comprising:

chambered passages axially disposed in each one of the set of blades for conducting exhaust gases; and at least one vane between plural chambered passages in each one of the set of blades.

4. The propeller of claim 1, further comprising:

an axially tapered section disposed in each one of the set of blades; and a matching and corresponding tapered section disposed in the center hub to receive and interlock with each one of the set of blades;

wherein such tapered sections have an axial taper in the range of 0.01 to 3.0 degrees that opens wider toward the aft of the propeller.

5. The propeller of claim 1, further comprising:

a nozzle section disposed in the rear cap and for expelling exhaust gasses that pass through the center hub and blades.

6. A modular counter rotating propeller system, comprising:

a front center hub with an aluminum core encapsulated with fiber-reinforced composite polymer with a first set of propeller-blade receptacles and for mounting on a rotating engine driveshaft;

a rear center hub with an aluminum core encapsulated with fiber-reinforced composite polymer with a second set of propeller-blade receptacles and for mounting on a counter-rotating engine driveshaft coaxial to said rotating engine driveshaft and aft of the front center hub;

a first set of replaceable propeller blades with plug-in bases that slip into and interlock with corresponding slots in the front center hub;

a second set of replaceable propeller blades with plug-in bases that slip into and interlock with corresponding slots in the rear center hub;

a first set of chambers disposed in said bases of the first set of replaceable propeller blades for receiving exhaust gases from an engine associated with said rotating and counter-rotating engine driveshafts, and for conducting such exhaust gases aft; and a second set of chambers disposed in said bases of the second set of replaceable propeller blades for receiving exhaust gases from the first set of chambers, and for conducting such exhaust gases out aft.

* * * * *